United States Patent [19]

Croci et al.

[11] 4,422,709

[45] Dec. 27, 1983

[54] MULTIPLE TRANSDUCER CONNECTOR

[75] Inventors: Dana Croci; David A. Kaplon, both of Harrisburg, Pa.

[73] Assignee: AMP Incorporated, Harrisburg, Pa.

[21] Appl. No.: 306,039

[22] Filed: Sep. 28, 1981

[51] Int. Cl.[3] ..... H01R 23/66

[52] U.S. Cl. ..... 339/176 MF; 339/17 F

[58] Field of Search ..... 339/17 F, 176 MF

[56] References Cited

U.S. PATENT DOCUMENTS

| | | | |
|---|---|---|---|
| 3,582,865 | 6/1971 | Franck et al. | 339/17 |
| 3,796,986 | 3/1974 | Tamburro | 339/176 MF |
| 3,851,294 | 11/1974 | Palazzetti et al. | 339/17 F |
| 4,087,146 | 5/1978 | Hudson, Jr. | 339/17 F |
| 4,169,641 | 10/1979 | Olsson | 339/17 F |
| 4,169,642 | 10/1979 | Mouissie | 339/17 F |
| 4,172,626 | 10/1979 | Olsson | 339/17 F |
| 4,202,595 | 5/1980 | Inouye et al. | 339/176 MF |

FOREIGN PATENT DOCUMENTS

| | | | |
|---|---|---|---|
| 2241888 | 3/1975 | France | 339/176 MF |

*Primary Examiner*—John McQuade

*Attorney, Agent, or Firm*—Allan B. Osborne

[57] ABSTRACT

The present invention relates to a connector for holding a number of transducers and a circuit film in electrical contact therebetween. More particularly, the connector includes a transducer block in which the transducers are positioned, spring elements which bias the circuit film against the transducers, and retention bars which hold the several components together.

2 Claims, 5 Drawing Figures

MULTIPLE TRANSDUCER CONNECTOR

The present invention relates to a connector for holding a number of transducers and a circuit film in electrical contact therebetween. More particularly, the connector includes a transducer block in which the transducers are positioned, spring elements which bias the circuit film against the transducers, and retention bars which hold the several components together.

The invention disclosed herein relates to connectors for cylindrical transducers wherein electrical signals to and from them are conveyed through traces on circuit film which is pressed against contact surfaces on the transducers.

Cylindrical transducers of the type shown in the several figures are of a singular form and designed for a specific purpose. Accordingly, there are no known connectors which provide for the electrical termination of these specific transducers.

The connector disclosed herein includes an insulating housing having an elongated block with transverse, transducer-receiving cavities extending along one or both sides. A circuit film having outwardly extending tabs spaced along one or both longitudinal sides is placed against the block so that the tabs, which have conductive traces thereon, may be pressed into the cavities and against conductive contact surfaces on the transducers which may be located therein. Further, a spring element is provided which consists of an elongated web with spaced spring fingers extending from one or both longitudinal sides. Means are also provided which hold the spring element and film against the transducers.

Figure 1:
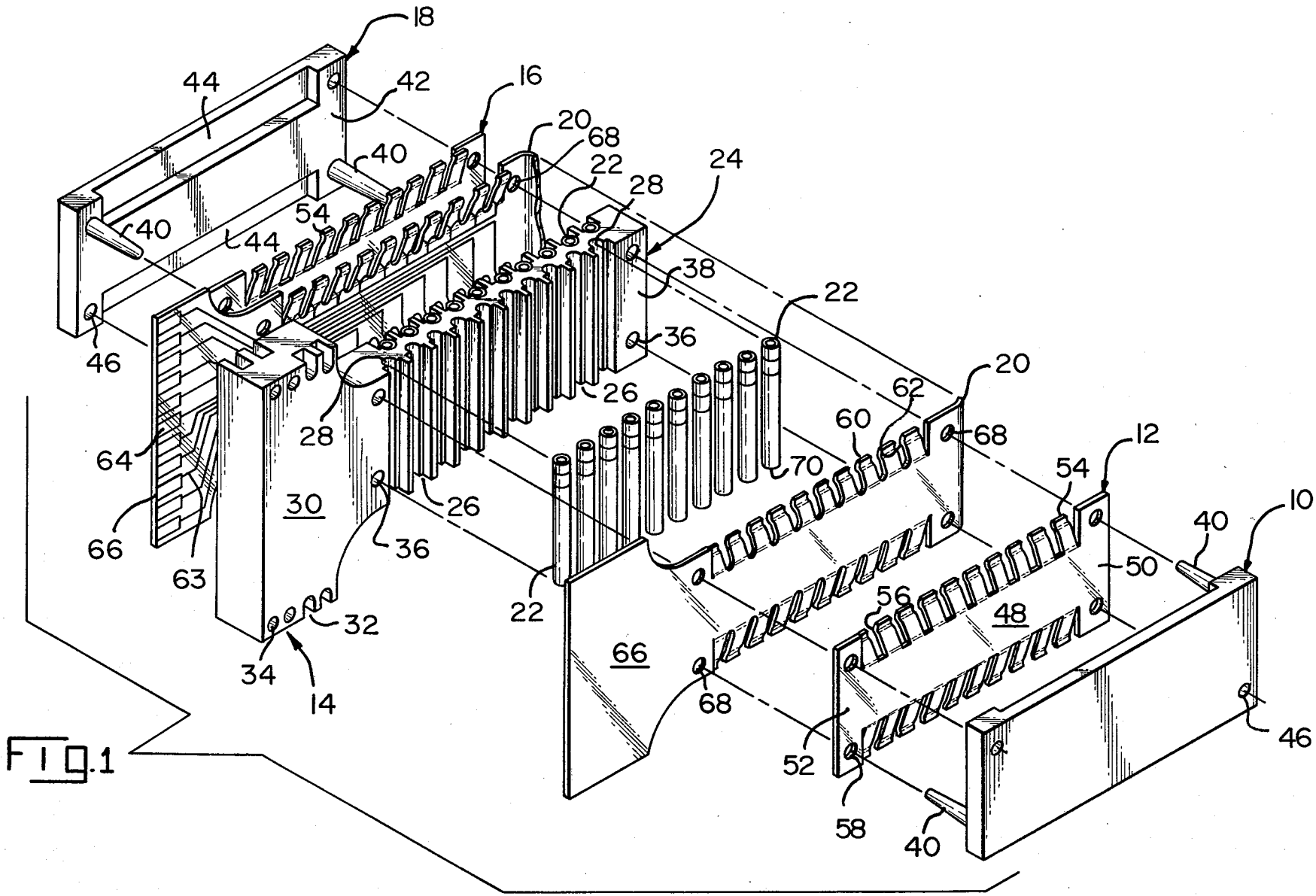
Figure 2:
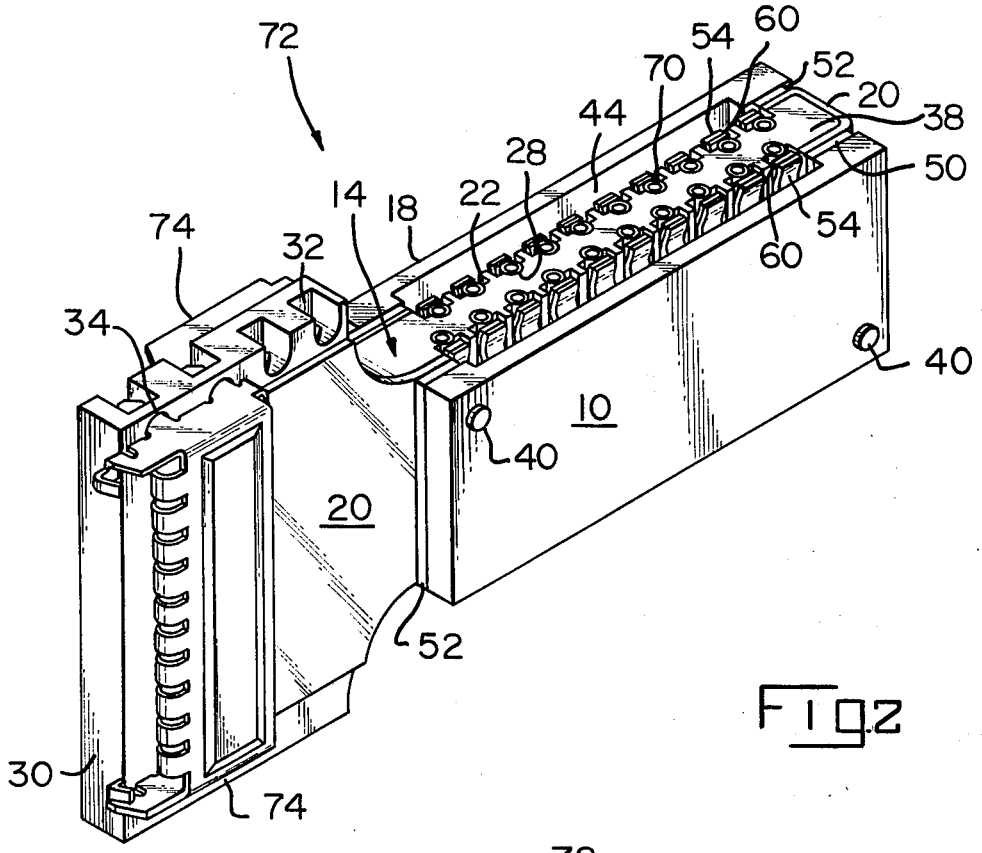
Figure 3:
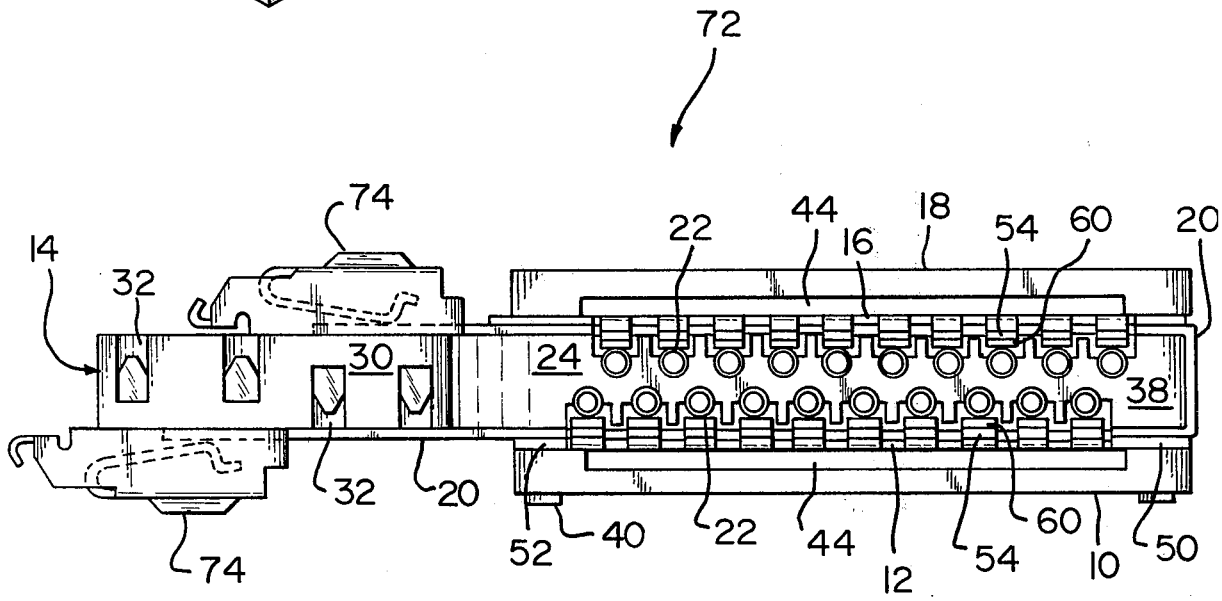
Figure 4:
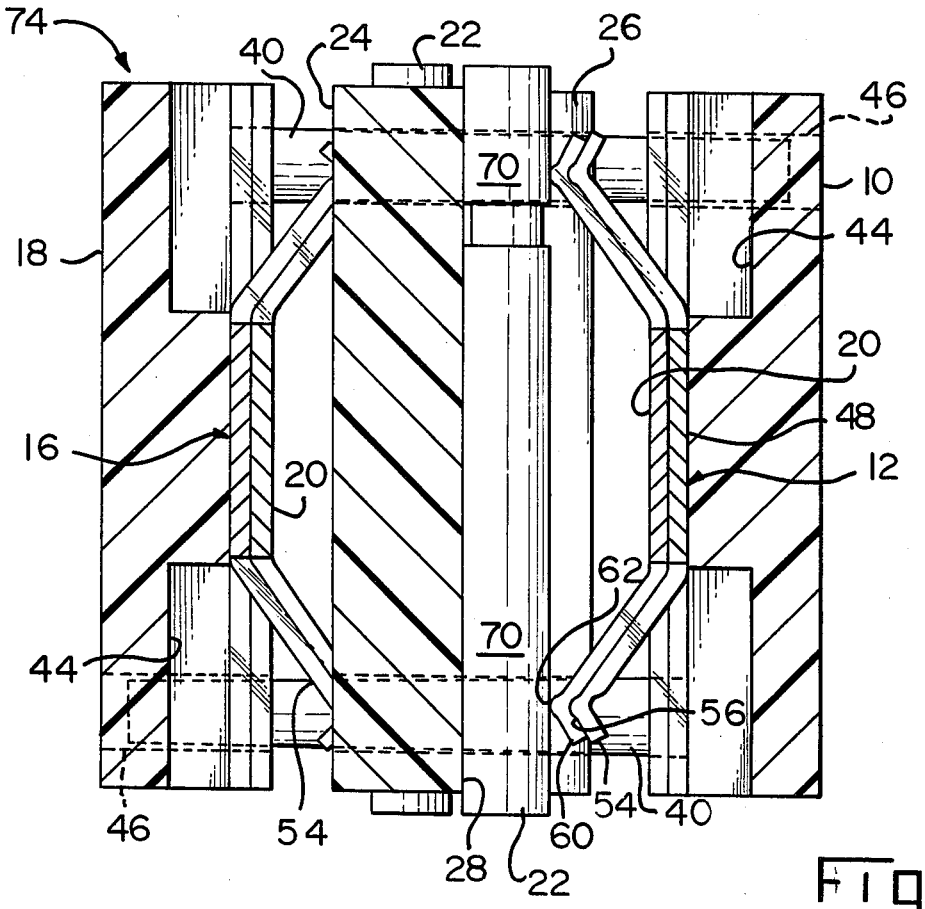
Figure 5:
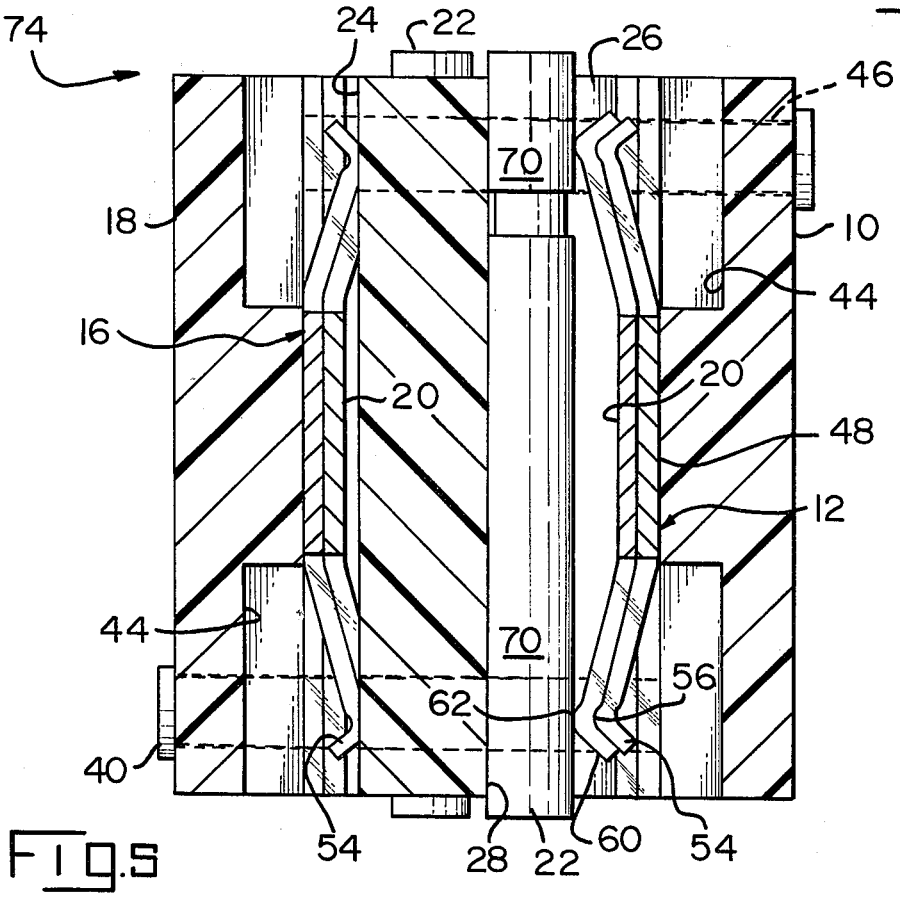

FIG. 1 is a perspective, exploded view of the components of the connector of the present invention along with the transducers and circuit film which are terminated therein, FIG. 2 is a perspective view of the connector of FIG. 1 subsequent to being assembled with the transducers and circuit film in place, and FIG. 3 is a top plan view of the connector of FIG. 2; and FIGS. 4 and 5 are cross-sectional views illustrating the termination between the transducers and circuit film.

The several components of the connector of the present invention are shown in exploded fashion in FIG. 1 and are, from right to left, first retention plate 10, first spring element 12, transducer housing 14, second spring element 16, and second retention plate 18. Also shown is circuit film 20, broken in two sections for illustration only, and transducers 22. The transducers are not part of the present invention. Further, transducers 22 could also be other electrical or electronic devices or electrical contact elements having contact surfaces at one or both ends. Accordingly, the present invention is not to be construed as being limited to terminating the illustrated transducers. The circuit film is made specifically for the illustrated application but from conventional materials and in a conventional manner.

As housing 14 is the basic component, the description of the components will begin there. The housing is molded from a suitable insulating material such as a polyester thermoplastic. An elongated block 24 has a plurality of transverse cavities 26 spaced along each side with the cavities on one side being offset longitudinally relative to the cavities on the opposite side.

An arcuate groove 28 is provided in the back wall of each cavity to receive a transducer 22. Accordingly, the transducers are very well protected from breakage and inadvertant electrical contact, both between transducers and from outside influences.

End 30 of housing 14, integrally connected to block 24, is enlarged to accommodate a connector clip (FIGS. 2 and 3) for circuit film 20. Notches 32 and bores 34 are provided to secure the clip to the end. Holes 36 are provided in end 30 and opposite end 38 of the housing through which pegs 40 on plates 10 and 18 pass.

With regard to plates 10 and 18, inside surface 42 from which pegs 40 project, are recessed along each longitudinal side as indicated by reference numeral 44. Further, each plate has two pegs, located diagonally one from the other. The corners not having pegs do have holes 46 in which the free ends of the pegs on the opposite plate are received.

Retention plates 10 and 18 are molded, preferably from a polyester thermoplastic. Preferably, they have generally the same overall length and width as elongated block 24.

Spring elements 12 and 16 are preferably stamped and formed from stainless steel and are identical. They have an elongated center web 48 transversely terminated at one end by wide bar 50 and at the other end by narrow bar 52.

A row of spaced-apart spring fingers 54 are attached to and extend obliquely away from each side of the web. The free ends of the fingers are curved to provide convex surfaces 56. FIGS. 4 and 5 illustrate clearly the shape and positioning of these fingers.

Holes 58 are provided in each bar for passage of pegs 40. The overall length and width approximates that of block 24 and the finger spacing is the same as the cavity spacing.

Circuit film 20 is U-shaped with each leg having tabs 60 spaced along each longitudinal side. The free ends 62 of the tabs are formed into a concavo-convex shape with the convex surface providing a contact; i.e., conductive traces 63 on the film extend from pads 64 on enlarged ends 66 down the legs and out the tabs to the convex surfaces. Each leg may contain a separate circuit or a single circuit may be provided by electrically connecting the circuits with traces around the bight.

Holes 68 are provided on both legs of the film in alignment such as to receive pegs 40 therethrough.

The tab spacing along the legs is identical to the spacing of cavities 26 and spring fingers 54.

Transducers 22 have conductive contact surfaces 70 near each end.

Center lines on the drawing in FIG. 1 indicate the way the connector is assembled to terminate transducers 22 to traces 63 on film 20. FIGS. 2 and 3 are views of the assembled connector, indicated by reference numeral 72.

With reference to FIGS. 1, 2, and 3, transducers 22 are positioned in grooves 28 in cavities 26. Circuit film 20 is wrapped around block 24 with ends 66 placed into connector clips 74 which had previously been mounted on both sides of housing end 30. The connector clips are sold by AMP Incorporated of Harrisburg, Pa. and are not part of the present invention. The tabs 60 on the film legs enters cavities 26 with the convex surface on ends 62 in alignment with ends 70 on transducers 22.

Spring elements 12 and 16, positioned over the film, have spring fingers 54 positioned in cavities 26 behind film tabs 60. The convex surfaces 56 are conformably positioned into the concave surface of the free ends 62 and press the tabs and traces 63 thereon against contact surfaces 70 on the transducers. Element 12 is positioned so that the wide bar 50 is adjacent end 38 on housing 14 and element 16 is positioned so that its wide bar 50 is adjacent end 30. This positioning accommodates the staggered location of cavities 26 in block 24. FIG. 3 illustrates this arrangement.

The several components and film are held together by plates 10 and 18 and pegs 40 which pass through the several holes (holes 58 on elements 12 and 16, holes 68 on film 20, and holes 36 in housing 14) and through holes 46 in the opposing plates. The free ends of the pegs which stick out from the opposite plates are reflowed, either ultrasonically or by heat to secure the assembly.

FIG. 4 is a cross-sectional view of connector 74 prior to pressing the components and film together. The view shows spring fingers 54 in a non-biased position. FIG. 5 is the same cross-sectional view as FIG. 4 but after the plates have been pressed in and the free ends of pegs 40 reflowed. In this drawing, the spring fingers 54 are biased so that they press film tabs 60 against contact surfaces 70 on transducers 22.

The connector of the present invention can be modified so that cavities 26 are spaced along one side of the block and one spring element 12/16 and one plate 10/18 provided. This modified connector would be used with a circuit film having one circuit.

Further, the connector can be modified to accept transducers or other electrical devices having a single conductive contact surface at one end. In this case, the spring element 12/16 and one plate 10/18 provided. This modified connector would be used with a circuit film having one circuit. Further, the connector can be modified to accept transducers or other electrical devices having a single conductive contact surface at one end. In this case, the spring element would have a single row of spring fingers.

Still another modification is to provide spring elements 12/16 and film 20 as a laminate. For example, the film would be laminated to one side of a copper plate and the spring elements laminated to the opposite side. After depositing the circuits on the film, the tabs-fingers would be stamped and formed. The use of a laminate would simplify handling and assembly as well as registering fingers 54 with tabs 60.

The present invention may be subject to many modifications and changes without departing from the spirit or essential characteristics thereof. The present embodiment is therefore intended in all respects as being illustrative and not restrictive of the scope of the invention.

We claim:

1. An electrical connector for terminating a plurality of cylindrical-shaped electrical devices having electrical contact surfaces at each end to a circuit film having conductive traces extending from an enlarged end outwardly to tabs spaced along and projecting from each longitudinal side of an elongated portion, said connector comprising:

a. a housing of insulating material having an elongated block with a plurality of spaced-apart cavities extending transversely across the block and further having at one end of the block means to receive the enlarged end of the circuit film;

b. a spring element of resilient material having a web with spring fingers projecting from each longitudinal side thereof in the same spaced-apart pattern as the tabs on the circuit film and the cavities in the elongated block, said fingers being preloaded by being bent out of the plane of the web, said element being attachable to the elongated block with the fingers in registration with the cavities so that upon placing electrical devices in the cavities and the elongated portion of the circuit film between the block and the spring element, the spring fingers thereon bias the circuit film tabs against the electrical contact surfaces at each end of the electrical devices to establish electrical contact therebetween.

2. The electrical connector of claim 1 wherein the transverse cavities are located on both sides of the elongated block and with two spring elements being provided.

* * * * *